United States Patent [19]

Kitay

[11] 4,063,731

[45] Dec. 20, 1977

[54] GOLF TOOL

[75] Inventor: Barry E. Kitay, Van Nuys, Calif.

[73] Assignees: Maurice Jay Cooper; Ethel Cooper, both of Venice, Calif.

[21] Appl. No.: 714,912

[22] Filed: Aug. 16, 1976

[51] Int. Cl.[2] ..... A63B 57/00

[52] U.S. Cl. ..... 273/32 B; 273/32 H; 81/90 C; 7/17; 7/1 R; 33/262; 273/33

[58] Field of Search ..... 273/32 R, 32 H, 32 B, 273/32 A, 33, 202, 203; 111/99; 33/262, 277, 278, 289; 7/1 R, 1 M, 17; 81/90 C

[56] References Cited

U.S. PATENT DOCUMENTS

| | | | |
|---|---|---|---|
| 2,107,944 | 2/1938 | Howard | 273/32 A |
| 3,203,700 | 8/1965 | Antonious | 273/32 A |
| 3,310,879 | 3/1967 | Brzezinski et al. | 273/32 B X |
| 3,658,331 | 4/1972 | Driscoll | 273/33 |
| 3,744,542 | 7/1973 | Stephens | 273/32 A X |
| 3,907,288 | 9/1975 | Hudak | 273/32 B |
| 4,007,928 | 2/1977 | Doubt | 273/32 B |

*Primary Examiner*—George J. Marlo
*Attorney, Agent, or Firm*—Bernard P. Drachlis

[57] ABSTRACT

There is disclosed a multi-purpose golfer's tool. The tool provides a distance estimating facility which in turn provides automatic selection of a golf club suitable for the distance so determined. A divot tool and dry-club-grip support are provided in addition to a cleat wrench, cleat cleaner and club-groove cleaner. Further, the invention includes a tee-height gauge and cigarette holder.

2 Claims, 5 Drawing Figures

Fig. 1.
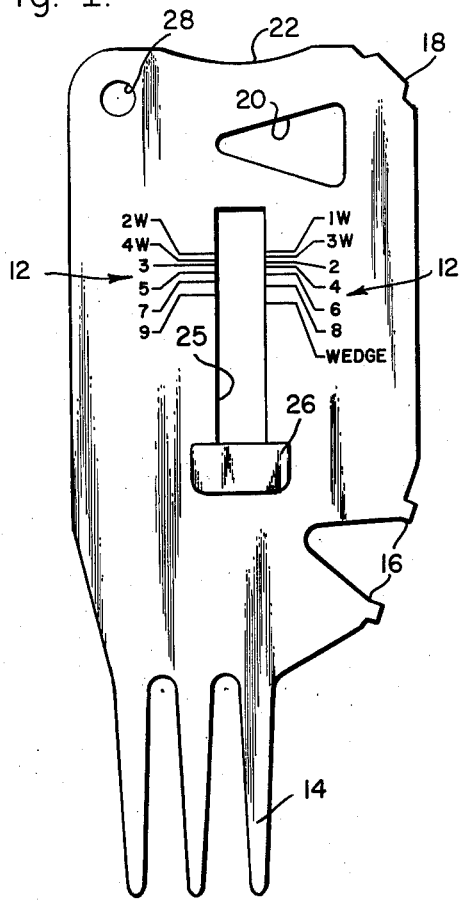
Fig. 2.
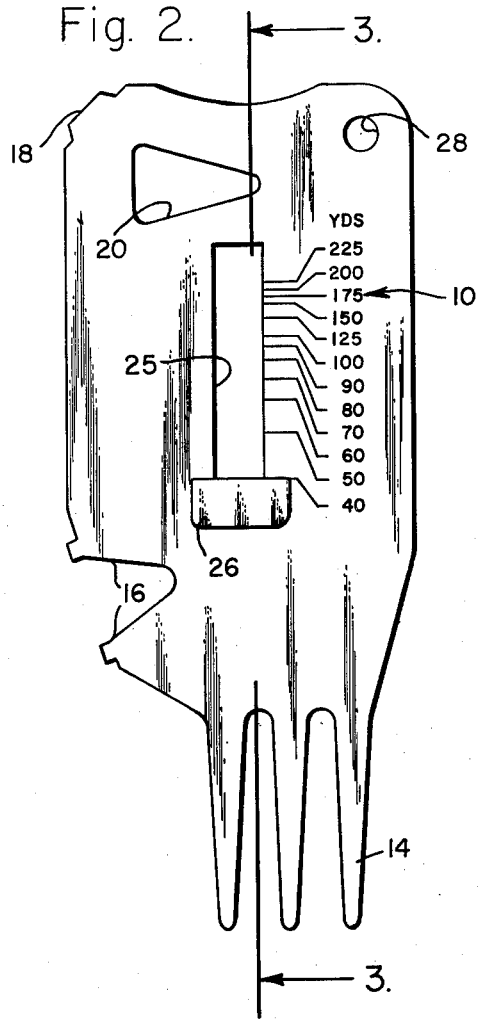
Fig. 3.
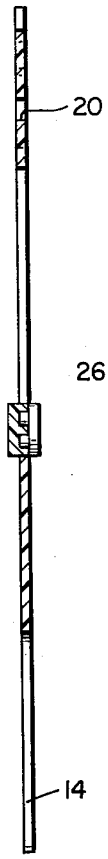
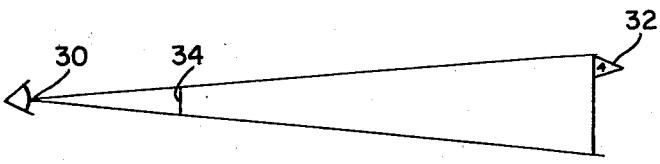
Fig. 5.
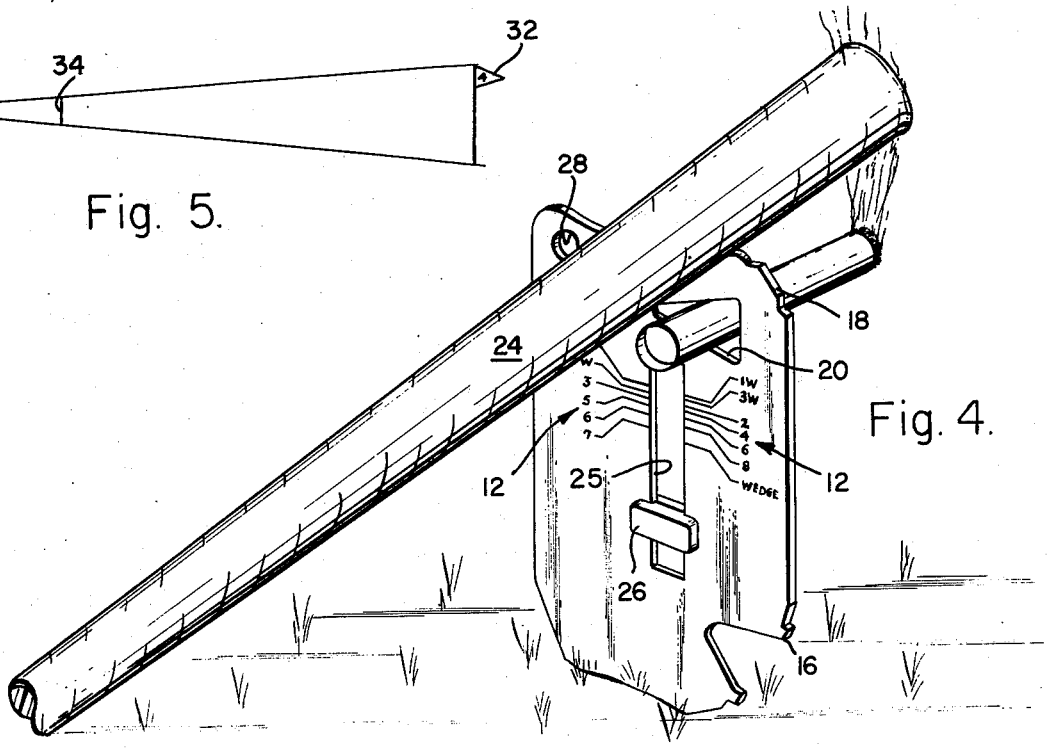
Fig. 4.

GOLF TOOL

BACKGROUND OF THE INVENTION

1. Field of the Invention

This invention relates generally to golfer's tools and more particularly to golfer's tools having a multiplicity of applications coordinated into a single apparatus.

2. Description of the Prior Art

The exploration of the problems of the golfer, experienced in a wide variety of golfing situations, has resulted in the development over the past several years of a progression of golfer's tools, ranging from a single-purpose tool to multipurpose tools so complex as to be prohibitively expensive or cumbersome. It has thus been necessary for a well-equipped golfer to either carry a number of single-purpose tools or, alternatively, to carry one of the cumbersome and expensive tools mentioned above.

It would be a great advantage to golfers and to the game of golf to provide an inexpensive, multipurpose golfer's tool that combines many of the desirable and necessary facilities in a simple, easy-to-carry apparatus.

SUMMARY OF THE INVENTION

The present invention provides a simple, inexpensive, multipurpose golfer's tool that is convenient to carry and that provides for many of the eventualities encountered during the playing of a game of golf. The tool is very sightly larger than the average key carried to one's automobile or door and is almost as convenient to carry on a conventional key ring. The tool may easily be accommodated in the space used to carry extra golf balls or in another compartment in a golf club bag. Among the functions included in the provisions of the tool are those of divot tool and dry-club-grip support, distance finder and automatic club selector, cleat wrench, cleat cleaner and club groove cleaner, tee height gauge and cigarette holder. The function of cigarette holder, which may appear frivolous to non-golfers or non-smokers, nevertheless performs an important health function for the smoking golfer as will be further described in the specification.

BRIEF DESCRIPTION OF THE DRAWINGS

FIG. 1 is a plan view of one lateral surface of the golf tool.

FIG. 2 is a plan view of the other lateral surface of the golf tool.

FIG. 3 is an edge view of the golf tool.

FIG. 4 is a perspective view of the golf tool.

FIG. 5 shows the geometry involved in the distance measuring function of the golf tool.

DESCRIPTION OF THE PREFERRED EMBODIMENT

Attention is first directed to FIGS. 1, 2 and 3 together. A slide or cursor, denoted by the numeral 26, is shown positioned at the bottom of a slot, identified by numeral 25, formed in the body of the invention. The construction of the slide and its dimensions are such that it is positionably stable by means of the friction between it and the walls of the slot 25. A scale denoted by numeral 10 in FIG. 2 is calibrated in yards and cooperates with a scale denoted by numeral 12 in FIG. 1 showing thereon various club selections. Cooperation of these two scales is effected by means of the cursor 26 and its variable positions within the slot 25.

Functional operation and cooperation of the scales 10 and 12 may be understood by means of an example. The standard height for a pole carrying a flag at a hole in a golf course is six feet from the grass level to the top of the pole. The slot 25, the cursor 26 and the scales 10 and 12 are dimensioned and calibrated such that a golfer of average height may make a distance estimation and thus also a club selection by the following method. The golf tool is held with the surface shown in FIG. 2, that is, with scale 10 toward the golfer, at a distance of approximately 24 inches from the eye of the golfer and at eye-level so that the flag on the pole at the hole whose distance from the golfer is to be determined is visible through the slot 25. The golf tool is then positioned so that the top of the flag pole is sighted at the top of the slot 25. The cursor 26 is now moved up the scale 10 until the top of cursor 26 is sighted at the bottom of the flag pole. The calibrated mark on scale 10 indicated by the top of cursor 26 will give a measure of the distance to the golf course hole indicated by the flag mounted on the pole in that hole and sighted through slot 25. If now the golf tool is turned over so that the surface shown in FIG. 1 may be seen, a club selection dependent upon the measured distance will be indicated on the scale 12. Cursor 26 is frictionally constrained to maintain its set position until repositioned by the golfer. The calibrated club selection scale is based on the average distances for which the different clubs are designed when used by the average golfer.

The calibration of the distance scale 10 is based on well known relationships of similar triangles as shown in FIG. 5. The eye of the observer is at the common vertex 30 of the two triangles. The larger triangle is defined by the flag pole 32 at the distant golf course hole. The smaller triangle is defined by the position of the device in the hand of the golfer designated as 34. An average distance of 24 inches is assumed from the eye of the golfer to the device held in the golfer's hand. Recall that the height of the flag pole is 6 feet or 72 inches. The opening $x$ of the slot 24, in inches, for any given distance in yards is given by the formula $$\frac{x}{72} = \frac{24}{(36)\,(\text{yds})} \text{ or } x = \frac{(24)\,(72)}{(36)\,(\text{yds})}$$

The divot tool, denoted by the numeral 14, is fabricated as a set of tines. This part of the golf tool is designed for use by the careful and considerate golfer to reelevate turf that has been depressed as a result of the ball falling on the smooth and soft greens. The tine construction further serves to support the tool in an upright position when the tines are pushed into the ground. It frequently happens that the grass on a golf course is wet, the handle will then become wet and the golfer's grip on the club will be impaired when he attempts to use the club again. The golf-club handle may be kept dry under these conditions by utilizing the dry-club-grip support 22 as illustrated in FIG. 4. The tines 14 are pushed into the round and the club handle 24 is cradled in the support 22 thus preventing the club handle from coming into contact with the wet grass. The club may now be used without impairment of the golfer's grip. The tines 14 of the divot tool may also be used as a cleat cleaning tool for the golfer's shoes when the cleats thereon become caked with mud as often happens on golf courses. The tines 14 of the divot tool may also be used as a shoe horn to help the golfer when changing from street shoes to golf shoes.

A cleat wrench, denoted by the numeral 16, is an additional facility of the golf tool. The cut-out as shown in FIGS. 1 and 2, is dimensioned to accommodate the spike portion of a golf shoe cleat while the protuberances shown fit into the cleat so as to screw the cleat into the shoe sole to tighten it. The cleat wrench may also be used to unscrew a worn cleat and to install a new cleat in its place.

It frequently happens that the grooves provided on the heads of golf clubs become caked with grass and other matter thus impairing traction between club and ball. A club groove cleaner, denoted by numeral 18, is provided so that the club grooves may be traced therewith and such matter removed.

A tee-height gauge, denoted by the numeral 20 is provided by the golf tool. This tee-height gauge is a cut-out in the shape of an isosceles triangle with rounded vertices. This gauge is designed for the ball-supporting part of a golf tee to be placed against the base of the triangular cut-out and the point of the tee to be pushed into the ground while being held in that position. The golf tee will thus be prevented from being driven too deeply into the ground by the edge of the golf tool since its edge will contact the ground before such occurrence.

The grass on golf courses is commonly treated with various insecticides and snail and slug poisons, etc. It is also common that golfers, having no convenient place to put a lighted cigarette while performing a shot will drop the cigarette on the grass. Upon completion of the shot, the golfer may retrieve the lighted cigarette from the poison-treated grass and resume smoking it. This golfer may now be made ill or worse from the poison ingested by placing the cigarette in his mouth after its contamination from contact with the grass. The tee-height gauge may double as a cigarette holder as shown in FIG. 4 thus preventing the possibility of the golfer's ingesting poison in the above manner.

A hole, denoted by the numeral 28, may be provided so that the tool can be attached as to a key chain for easy portability.

The golfer's tool may be fabricated from any convenient rigid or semi rigid material. A rigid metal material is preferred especially for the divot tool, cleat wrench, cleat cleaner and club groove cleaner functions of the device.

Thus, there has been described a golfer's tool intended to be used in a multiplicity of situations encountered on the golf course while playing the game of golf. The tool, as contemplated by the invention, is inexpensive, convenient to use and presents no problem of awkwardness, complexity or portability.

Although the present invention has been shown and described with reference to a particular embodiment, nevertheless, various changes and modifications obvious to one skilled in the art to which the invention pertains are deemed to lie within the purview of the invention.

What is claimed is:

1. A golfer's tool fabricated from a flat plate of semi rigid sheet material comprising in combination;

distance measuring and club selection scales inscribed on opposite lateral surfaces of said flat plate;

an indicating cursor situate in a longitudinal slot formed in the flat plate;

a formation of tines at one end of the flat plate;

a concave cradle formed at another end of the flat plate defining a dry-club-grip support;

a tee-height gauge formed in the flat plate as a triangular shaped, cut-out aperture;

a cleat wrench formed in the flat plate at a lower side edge as a pair of tab protuberances and a cleat-accommodating cut-out;

a club groove cleaner formed on said flat plate at an upper side edge as a truncated, wedge-like protuberance; and the flat plate having a hole at another upper side edge as an attachment device.

2. The golfer's tool of claim 1 wherein said distance measuring and club selection scales are calibrated in yards and club identification numbers respectively.

* * * * *